US006998547B2

(12) United States Patent
Kloth et al.

(10) Patent No.: US 6,998,547 B2
(45) Date of Patent: Feb. 14, 2006

(54) ON-LOAD TAP CHANGER FOR A SEQUENCE SWITCH

(75) Inventors: Günter Kloth, Saal (DE); Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 10/515,614

(22) PCT Filed: Mar. 10, 2004

(86) PCT No.: PCT/EP2004/002445

§ 371 (c)(1),
(2), (4) Date: Nov. 19, 2004

(87) PCT Pub. No.: WO2004/084241

PCT Pub. Date: Sep. 30, 2004

(65) Prior Publication Data

US 2005/0205394 A1 Sep. 22, 2005

(30) Foreign Application Priority Data

Mar. 19, 2003 (DE) ..... 103 12 176

(51) Int. Cl.
*H01H 9/30* (2006.01)

(52) U.S. Cl. ..... 200/6 R; 200/11 TC

(58) Field of Classification Search ..... 200/6 R, 200/11 TC, 11 A, 14, 11 K, 284, 400
See application file for complete search history.

(56) References Cited

U.S. PATENT DOCUMENTS

| | | | | |
|---|---|---|---|---|
| 3,624,319 | A * | 11/1971 | Ristuccia | 200/11 A |
| 3,902,030 | A * | 8/1975 | Popa | 200/11 TC |
| 4,112,274 | A * | 9/1978 | Pigman et al. | 218/8 |
| 5,034,578 | A * | 7/1991 | Lauterwald | 200/11 B |
| 5,315,078 | A * | 5/1994 | Freymuller | 200/11 TC |
| 5,523,535 | A * | 6/1996 | Larsson et al. | 200/11 TC |
| 5,834,717 | A * | 11/1998 | Neumeyer et al. | 200/17 R |
| 6,693,248 | B1 * | 2/2004 | Schultz | 200/11 TC |
| 6,838,629 | B1 * | 1/2005 | Baertl | 200/501 |

FOREIGN PATENT DOCUMENTS

| | | |
|---|---|---|
| AT | 1 175 336 | 8/1964 |
| CH | 453 492 | 6/1968 |
| DE | 195 42 880 | 2/1997 |
| EP | 0 151 740 | 8/1985 |
| EP | 1 197 977 | 4/2002 |

* cited by examiner

*Primary Examiner*—K. Richard Lee
(74) *Attorney, Agent, or Firm*—Herbert Dubno

(57) ABSTRACT

A load changeover switch for a tap changer with two permanent main contact pairs for each phase to be switched, wherein the fixed contacts thereof are each time bridged over by a movable permanent main contact. The fixed permanent main contacts consist of a plurality of contact plates, which are articulated by means of contact springs, in the manner that the direction of deflection of the individual contact plates corresponds in each instance with the direction of impinging of the movable permanent main contact.

5 Claims, 4 Drawing Sheets

SECTION A-A

ON-LOAD TAP CHANGER FOR A SEQUENCE SWITCH

CROSS REFERENCE TO RELATED APPLICATIONS

The present application is the US national phase of PCT/EP2004/002445 filed 10 Mar. 2004 and based upon German national application 103 12 176.5 of 19 Mar. 2003 under the International Convention.

FIELD OF THE INVENTION

The invention relates to a load changeover switch for a tap changer with permanent main contacts switching free of power for each phase.

BACKGROUND OF THE INVENTION

Such a load changeover switch is known from DE 100 50 895 C1. It comprises, for each phase to be switched, two permanent main contact pairs which can be alternatively bridged over by a single movable electrically conductive permanent main contact pivotable into two different end settings. In that case in each instance one of the two permanent main contact pairs is bridged over in the stationary state and conducts the permanent current in such manner that at the beginning of each load changeover of the tap changer the permanent main contact pair previously conducting the permanent current is opened and at the end of each load changeover—after lapsing of the entire changeover sequence—the other, previously opened permanent main contact pair is bridged over and takes over the permanent current. For that purpose there is arranged in the interior of the load changeover switch a centrally extending switch shaft by which the movable electrically conductive permanent main contact—thus the bridging-over contact—is actuatable. Each permanent main contact pair consists of a first and a second permanent main contact, which are electrically insulated from one another. One of these first permanent main contacts is electrically connected with one side A, and the other of these first permanent main contacts with the other side B, of the load changeover switch. The two second permanent main contacts are electrically connected with a common load shunt of the load changeover switch. The movable permanent main contact has a run-up surface which is spherically constructed in such a manner that it is disposed in constant connection with the two second permanent main contacts of the two permanent main contact pairs, which are electrically connected with the load shunt, and slides or rolls on these. In a specific region it has such a profile departing therefrom that lateral contact surfaces are formed so that it alternatively electrically contacts one of the respective permanent main contacts of one of the two permanent main contact pairs only in each of the two possible end settings. In other words: in one end setting of the movable permanent main contact the side A of the load changeover switch is connected with the load shunt and in the other end setting the side B of the load changeover switch is connected with the load shunt. The wiring of the respective first permanent main contacts of the two permanent main contact pairs, which are electrically connected with the side A or B, is in that case effected so that the movable permanent main contact when it is pivoted into one of its end positions—thus the respective first permanent main contact or more precisely the individual contact plates thereof—is urged outwardly against the force of the respective contact springs at which these are articulated, i.e. they are spread apart.

However, it has proved that this spreading apart of the contact plates has a number of disadvantages. On the one hand, switching of the appropriate corresponding contact surface of the movable permanent main contact to the corresponding first permanent main contact takes place relatively slowly; this is caused by the geometry of the profile and the movement direction of the individual contact plates and has the consequence, due to the reasons explained in the following, of poor values for the strength of insulation of the entire arrangement and thus the voltage strength of the load changeover switch: in the case of each load changeover, initially the permanent main contact switches off the side previously conducting current, i.e. the movable permanent main contact separates from the corresponding fixed permanent main contact pair, and thereafter switches off the actual switching contact. The movable permanent main contact, until opening of the actual switching contact, has to have covered a specific travel path in order to thereby ensure a specific voltage strength. This travel path in the case of known load changeover switches is—as explained—relatively small, which has a negative effect on the voltage strength.

On the other hand, the slow sliding-on and spreading-apart of the individual contact plates due to the movable permanent main contact leads to an increased friction. The force for overcoming this friction has to be additionally exerted by the force store. This problem is additionally aggravated by the fact that the switching-to of the permanent main contact takes place—as further explained above—entirely at the end of the load changeover, thus at a point in time at which the stored energy of the force store is already almost exhausted. Finally, the known solution also requires a very high dimensional accuracy not only of the movable permanent main contact, but also of contact plates; even the smallest production tolerances can have the consequence that the friction increases in such a manner that the movable permanent main contact can no longer completely switch to the plates of the respective fixed permanent main contact and thus the entire load changeover switch does not reach its end setting or reaches it only with difficulty.

OBJECT OF THE INVENTION

The object of the invention is accordingly to indicate a load changeover switch of the kind stated in the introduction in which the described permanent main contact pairings can be actuated in simple manner and without detraction from the electrical strength.

SUMMARY OF THE INVENTION

This object is met by a load changeover switch with the features of the first patent claim. The subclaims concern advantageous developments of the invention.

The general idea underlying the invention is that the direction in which the resiliently articulated contact plates of the respective first permanent main contacts are deflectable against the corresponding spring force corresponds at least approximately with the direction of impinging of the movable permanent main contact or stated more precisely the profile of the movable permanent main contact. The movable permanent main contact thereby impinges precisely, in the direction of deflection thereof, on the respective contact plates; in kinematic terms this is approximately comparable with the collision of two railway buffers, of which one is sprung. In that case the impinging takes place very rapidly, i.e. with high contact closing and contact opening speed. This yields good voltage strength, since a relatively high travel path is covered by the movable permanent main contact within a very short time. In addition, in this mode and manner of impinging of the movable contact on the fixed contact resiliently movable in the same direction only low demands on accuracy are imposed and no additional friction forces arise. Merely the force for overcoming the contact spring forces has to be exerted. The switching of the movable permanent main contact to the respective fixed permanent main contact takes place abruptly; substantially less wear arises than in the case of the frictional connection according to the state of the art. A further advantage of the invention consists in that, during the switching-off, the movable permanent main contact is urged away from the fixed contacts by the corresponding spring force, i.e. no additional force is necessary for the switching-off. By contrast thereto, in the state of the art friction forces also have to be overcome during the switching-off.

BRIEF DESCRIPTION OF THE DRAWING

The invention will be explained in still more detail in the following by way of example with reference to the accompanying drawing, in which.

SPECIFIC DESCRIPTION

Figure 1:
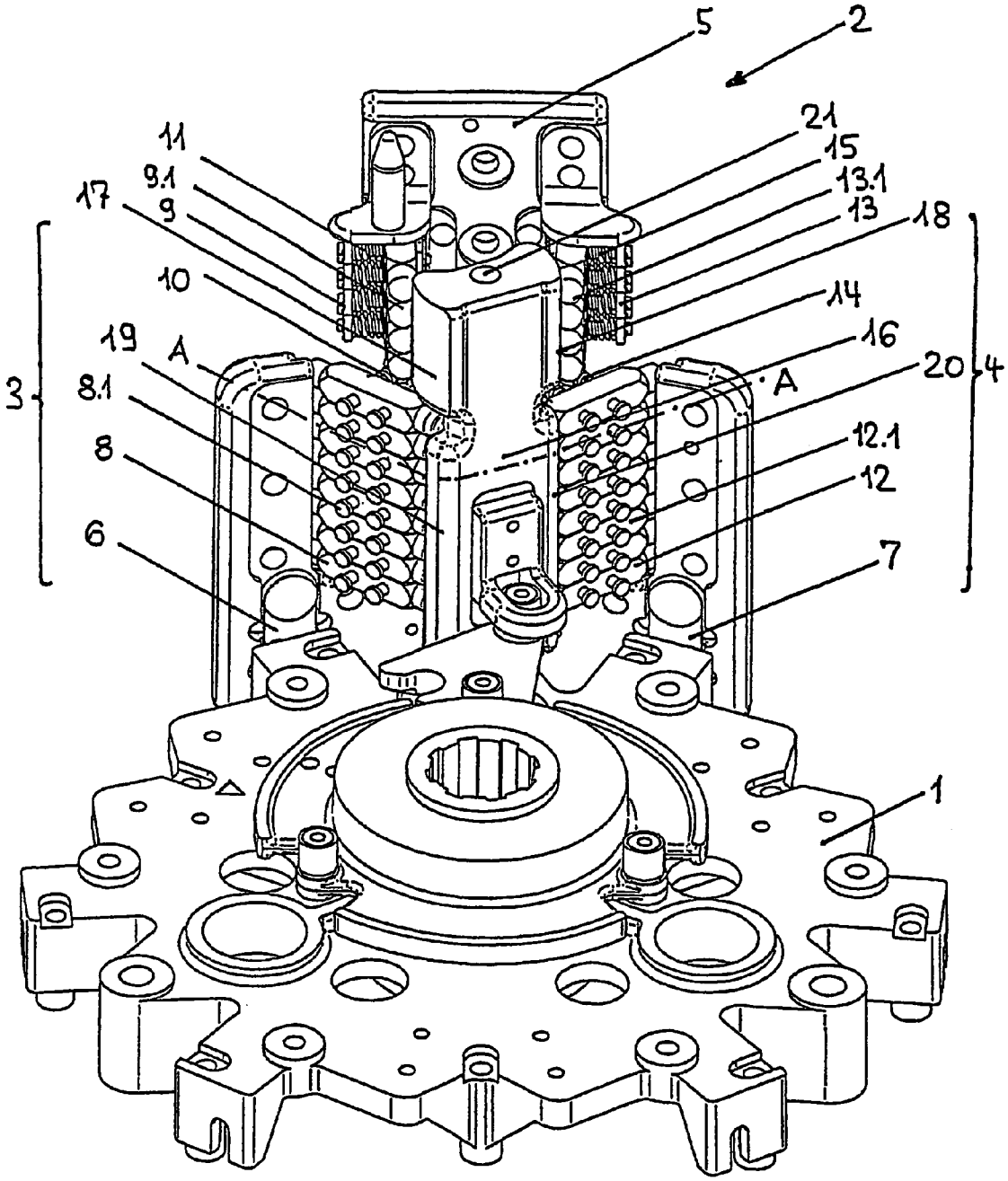
FIG. 1 shows a first load changeover switch according to the invention with permanent main contacts in schematic, perspective illustration, wherein for reasons of better clarity a number of components and switching means, which are not absolutely necessary for explanation of the invention, are omitted.

Initially the load changeover switch illustrated in FIGS. 1 and 2 will be explained in more detail. The supporting element of this road changeover switch is a base plate 1, which receives and carries for each phase the movable permanent main contacts and the means for actuation thereof. Only one such complete permanent main contact 2 is illustrated here. Fixed permanent main contact pairs 3, 4 are fastened, to be co-operating therewith, at the inner wall of an oil vessel (not illustrated) which encloses the entire load changeover switch. For this purpose three contact carriers 5, 6, 7 are provided for each phase. The first fixed permanent main contact pair 3, consisting of fixed permanent main contacts 8 arranged at the bottom and electrically connected with one side A of the load changeover switch and fixed permanent main contacts 9 arranged thereabove and leading to the common load shunt of the load changeover switch, is arranged at the left-hand side. It can be seen that each of the fixed permanent main contacts 8 and 9 consists of a plurality of individual contact plates 8.1 and 9.1, respectively. Each of the contact plates 8.1 and 9.1 is resiliently articulated by means of contact springs 10 and 11, respectively. The second fixed permanent main contact pair 4 is disposed on the right-hand side. This consists in entirely analogous manner of fixed permanent main contacts 12 arranged at the bottom and electrically connected with the other side B of the load changeover switch and fixed permanent main contacts 13 arranged thereabove and leading to the common load shunt. In addition, in this case each of the fixed permanent main contacts 12 and 13 consists of a plurality of individual contact plates 12.1 and 13.1, respectively, which are in turn individually resiliently articulated in entirely analogous manner by contact springs 14 and 15, respectively. The fixed permanent main contacts 9 and 13 are arranged on the first electrically conductive contact carrier 5 and form the common load shunt. The fixed permanent main contacts 8 are arranged on the second contact carrier 6 and connected with the side A of the load changeover switch and the fixed permanent main contacts 12, electrically insulated therefrom, are arranged on the third contact carrier 7 and connected with the side B of the load changeover switch.

In addition, a common movable permanent main contact 16, which is electrically conductive, is provided. In has in the upper region at its left-hand side a run-up surface 17 which corresponds with the fixed permanent main contacts 9 as well as on its right-hand side a run-up surface 18 which corresponds with the fixed permanent main contacts 13. In its lower region it has at the left-hand side a contact surface 19, which corresponds with the fixed permanent main contacts 8, as well as the right-hand side in entirety analogous manner a further contact surface 20, which in turn corresponds with the fixed permanent main contacts 12. The movable permanent main contact 16 has a bearing 21 (not illustrated in more detail) in such a manner that it is pivotable in the longitudinal axis of the load changeover switch about a center position. The pivot path of the permanent main contact 6 is indicated in the figures by two double arrows. The two run-up surfaces 17, 18 are, as known according to the state of the art, spherically dimensioned in such a manner that on pivoting of the movable permanent main contact 16 about its bearing 21 they remain constantly in contact with the fixed permanent main contacts 9 and 13, which, as explained above, are both connected with the electrical load shunt of the load changeover switch; this takes place in the form of a sliding or rolling. In other words: the electrical connection of the movable permanent main contact 16 with the load shunt permanently exists independently of the setting of the movable permanent main contact 16.

By contrast thereto the two contact surfaces 19 and 20, which are respectively arranged at the bottom, of the movable permanent main contact 16 are constructed in such a manner that they come into contact with the respective corresponding fixed permanent main contacts 8 and 9 only on pivoting of the movable permanent main contact 16 into one of its two end positions. In that case, according to the invention the articulation of the contact plates 8.1 and 12A to the contact springs 10 and 14, respectively, takes place in the manner that the longitudinal axis of the contact springs 10, 14 extends each time in the same direction as the direction of impinging of the respective contact surface 19 or 20.

This has the effect that the movable permanent main contact 16 on impinging on the respective contact plates 8.1 or 12.1 in the respective end setting deflects these precisely in its movement direction against the spring force without running-up or lateral spreading taking place.

Figure 2:
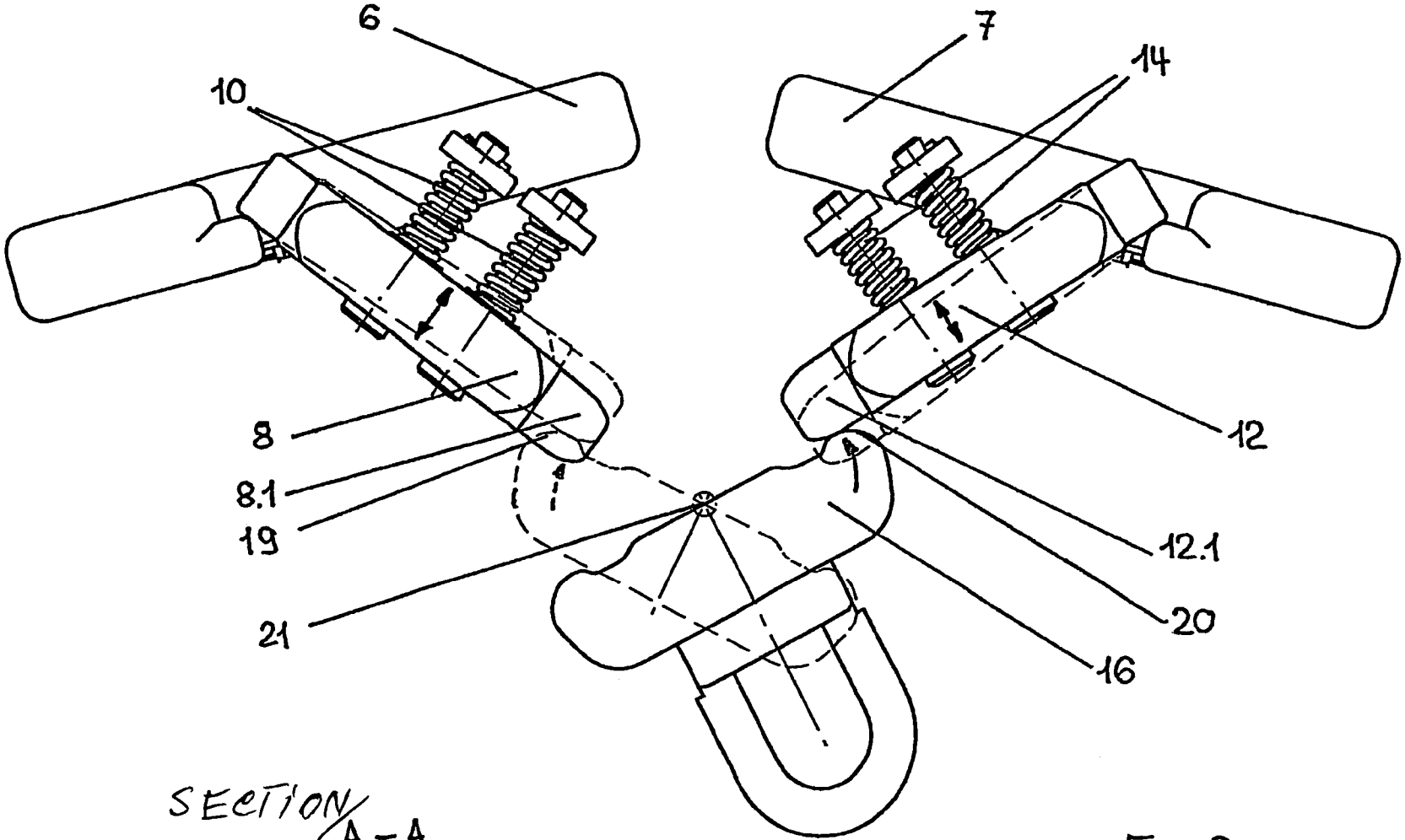
FIG. 2 shows a similarly schematic sectional illustration of the fixed permanent main contacts in a first plane A—A according to FIG. 1 in co-operation with the movable permanent main contact of this first load changeover switch according to the invention.

FIG. 2 shows a section in the plane A—A. In this FIG. 2 the correspondence of the direction of movement of movable permanent main contact 16 and longitudinal direction of the corresponding contact springs 10 and 14—depending on the respective end setting—is shown in detail once again. The movement direction of the movable permanent main contact 16 on reaching an end setting and the direction of deflection of the contact plates 8.1 of the fixed permanent main contact 8, on which it then impinges, are indicated by arrows. The other end setting of the permanent main contact 16, in which it impinges in entirely analogous manner on the contact plates 12.1 of the fixed permanent main contact 12, are indicated by a thin dashed line.

Figure 3:
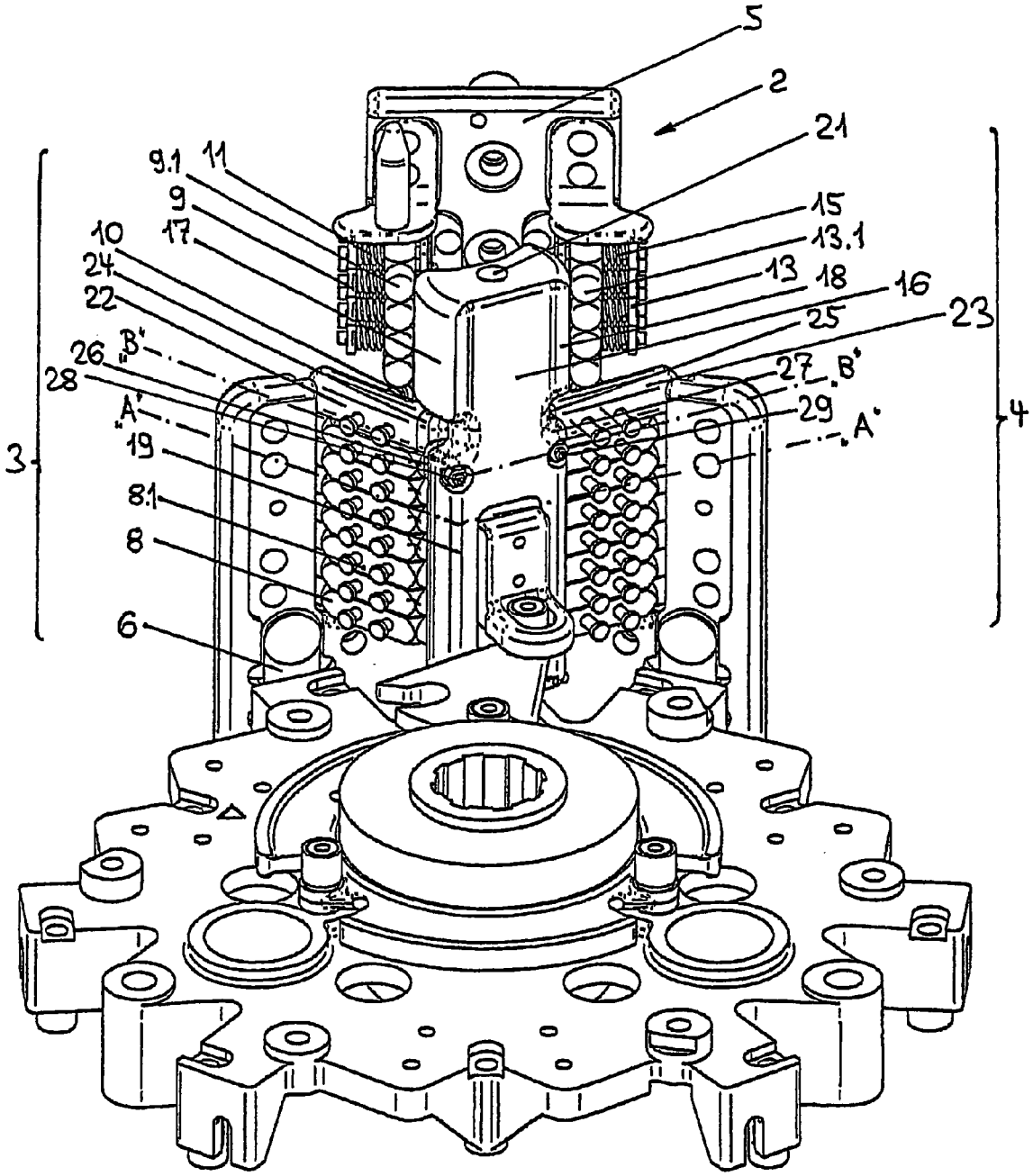
FIG. 3 shows a second load changeover switch according to the invention in schematic, perspective illustration.
Figure 4:
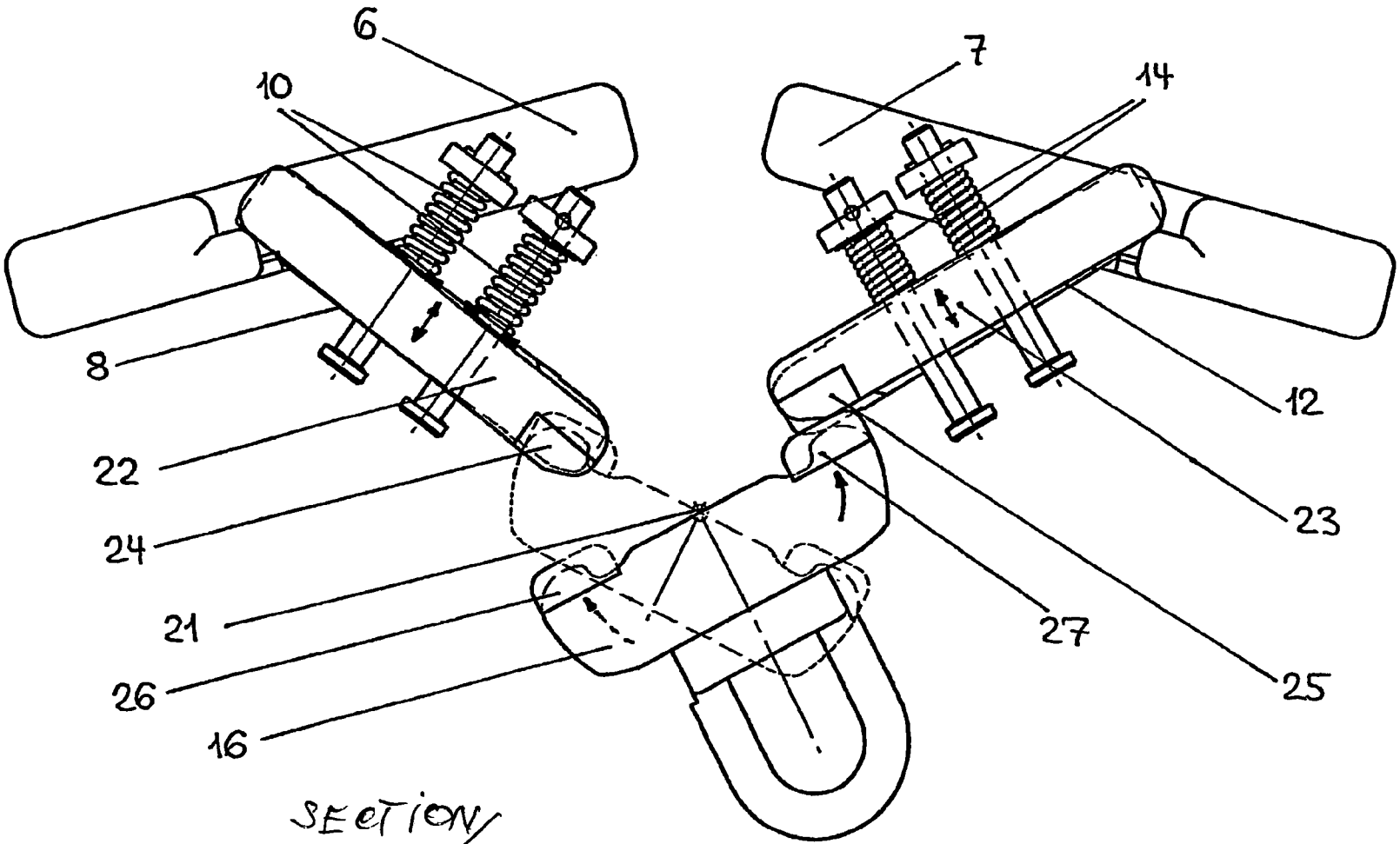
FIG. 4 shows, again, a schematic sectional illustration of the fixed permanent main contacts in a second plane B—B according to FIG. 3 in co-operation with the movable permanent main contact of this second load changeover switch according to the invention, the schematic sectional illustration in the plane A—A according to FIG. 3 being identical with FIG. 2.

A second, further developed load changeover switch according to the invention, as illustrated in FIGS. 3 and 4, shall be described in the following. The same parts are provided with the same reference numerals; the arrangement and mode of function of the parts denoted by the reference numerals 1 to 21 are unchanged relative to the above-explained first example of embodiment, for which reason repetition is dispensed with here. FIG. 4 shows a sectional Illustration in the plane B—B.

When the permanent main contact 2 switches, in certain operating conditions undesired arcs can arise, which can similarly lead to an undesired contact burning at the contact plates 8,1, 9.1 of the fixed permanent main contacts 8, 9, just as at the movable permanent main contact 16. In order to avoid this, here the fixed permanent main contact 8 has a specially constructed erosion contact plate 22 arranged at the top, just as the fixed permanent main contact 9 has a corresponding erosion contact plate 23. In the region of the contact-making with the movable permanent main contact 16 the erosion contact plates 22, 23 each have an erosion contact insert 24, 25 of a special burning-proof material, for example tungsten-copper. In corresponding manner, the movable permanent main contact 16 also has in the corresponding region of the contact-making with the erosion contact plates 22, 23 in each instance a special erosion contact insert 26, 27 with the same described properties.

The resiliently arranged fixed erosion contact plates 22, 23—as also the erosion contact inserts 26, 27 at the movable permanent main contact 16—are in that case geometrically constructed in such a manner that, in the case of a switching movement of the permanent main contact 16 on the corresponding side A or B to which there is switching, they firstly come into contact with one another, i.e. before the remaining contact plates 8.1 and 9.1 not equipped with this special material are switched. On switching in the other direction, i.e. on leaving the previous position of the movable permanent main contact 16, the fixed erosion contact plates 22, 23 only come out of contact with the corresponding erosion contact insert 26, 27 as the last thing, i.e. only after all remaining contact plates 8.1 and 9.1 have already come out of contact. It is thereby ensured that a possibly arising arc always occurs only between the special burning-resistant erosion contact inserts 24 and 25 of the erosion contact plates 22 and 23, respectively, as well as the erosion contact inserts 26 and 27 respectively co-operating therewith and the other contact pairings are reliably protected against such an arc and thus undesired burning.

It is also possible within the scope of the invention to provide each time the entire special erosion contact plates 22, 23 of the special burning-proof material and to dispense with the described separate erosion contact inserts.

Moreover, it is obviously also possible within the scope of the invention to provide in each instance more than one such special contact pairing constructed to be resistant to burning.

It would similarly also be possible to produce all contact plates 8.1, 9.1 and also the entire movable permanent main contact 16 from this special burning-proof material, but this is not usually realized for reasons of cost.

The form of embodiment of the load changeover switch shown in FIGS. 3 and 4 thus has two additional advantages. On the one hand it is not necessary to equip all contact plates with the expensive tungsten-copper material. On the other hand, in the case of inspections or the like only the erosion contact plates 22, 23 as well as the erosion contact inserts 26, 27 have to be exchanged in simple manner; virtually no wear occurs at the other contact pairings. In order to further facilitate exchange of the erosion contact inserts 26, 27, in a special development of the invention these are separately screw-connected with the movable permanent main contact 16 by means of screws 28, 29.

REFERENCE NUMERAL LIST

1 base plate
2 permanent main contact complete for a phase
3 fixed permanent main contact pair
4 fixed permanent main contact pair
5 first contact carrier, connected with the load shunt
6 second contact carrier, connected with the side A
7 third contact carrier, connected with the side B
8 lower permanent main contact of 3, connectable with A
9 upper permanent main contact of 3, connected with the load shunt
8.1 contact plates of 8
9.1 contact plates of 9
10 contact springs for 8.1
11 contact springs for 9.1
12 lower permanent main contact of 4, connectable with B
13 upper permanent main contact of 4, connected with the load shunt
12.1 contact plates of 12
13.1 contact plates of 13
14 contact springs for 12.1
15 contact springs for 13.1
16 movable permanent main contact
17 run-up surface, rolling on 9
18 run-up surface, rolling on 13
19 contact surface, impinging on 8
20 contact surface, impinging on 12
21 bearing
22 erosion contact plate of 8
23 erosion contact plate of 12
24 erosion contact insert at 22
25 erosion contact insert at 23
26 erosion contact insert at 16
27 erosion contact insert at 16
28 screw
29 screw

What is claimed is:

1. A load changeover switch for a tap changer, wherein for each phase to be switched there are provided two fixed permanent main contact pairs which can be bridged over by a single movable electrically conductive permanent main contact pivotable into two different end settings, wherein in each phase to be switched a respective one of the two permanent contact pairs is bridged over in the stationary state and conducts the constant current, wherein each of the two permanent main contact pairs consists of a respective lower permanent main contact and a respective upper permanent main contact electrically insulated therefrom, wherein one lower permanent main contact is electrically connected with a side (A), and the other lower permanent main contact with a second side (B), of the load changeover switch, wherein the two upper permanent main contacts are electrically connected with a common load shunt of the load changeover switch, wherein the movable permanent main contact is disposed in constant electrical connection with the upper permanent main contacts, wherein the movable permanent main contact has in a region and on either side a respective contact surface in such manner that alternatively one of the two contact surfaces is disposed in electrical connection with a respective one of the lower permanent main contacts only in each of the two end settings, and wherein each of the lower permanent main contacts consists of a plurality of individual contact plates and each of the contact plates is resiliently articulated by means of a contact spring, the longitudinal axes of the contact springs at which the contact plates are respectively articulated extending in the same direction as the direction of impinging of the respective contact surface of the movable permanent main contact in such a manner that the direction of deflection of the contact plates and thus of the lower fixed permanent main contacts respectively corresponds with the direction of impinging of the movable permanent main contact.

2. The load changeover switch according to claim 1 wherein each time at least one of the contact plates of the lower fixed permanent main contacts is constructed as an erosion contact plate and consists entirely or partly of burning-resistant material, the movable permanent main contact in the region of the contacting-making with the erosion contact plates has a respective erosion contact insert similarly of burning-resistant material and that the erosion contact plates and the corresponding erosion contact inserts are geometrically constructed in such a manner that with each switching movement of the movable permanent main contact into one of the two end positions they come as first thing into contact with one another each time before the remaining contact plates of the respective side are switched and go as last thing out of contact after the remaining contact plates of the respective side being switched have already gone out of contact with the permanent main contact.

3. The load changeover switch according to claim 2 wherein the erosion contact plates in the region of the contacting with the respective erosion contact inserts of the movable permanent main contact similarly have erosion contact inserts and only these consist of burning-resistant material.

4. The load changeover switch according to claim 2 wherein the erosion contact inserts are fastened to the movable permanent main contact by means of screws.

5. The load changeover switch according to claim 2 wherein a tungsten-copper alloy is used as burning-resistant material.

* * * * *